US006176646B1

(12) United States Patent
Finn et al.

(10) Patent No.: US 6,176,646 B1
(45) Date of Patent: Jan. 23, 2001

(54) RISER GUIDE AND SUPPORT MECHANISM

(75) Inventors: Lyle David Finn, Sugarland; Paul Nelson Stanton, Houston, both of TX (US)

(73) Assignee: Deep Oil Technology, Incorporated, Houston, TX (US)

( * ) Notice: Under 35 U.S.C. 154(b), the term of this patent shall be extended for 0 days.

(21) Appl. No.: 09/178,090

(22) Filed: Oct. 23, 1998

(51) Int. Cl.[7] ..... E21B 17/00; E21B 43/01

(52) U.S. Cl. ..... 405/224.2; 405/195.1; 166/350; 166/367

(58) Field of Search ..... 166/350, 359, 166/367; 405/195.1, 224.2

(56) References Cited

U.S. PATENT DOCUMENTS 4,176,986 * 12/1979 Taft et al. ..... 405/195.1 X
4,708,525 * 11/1987 Beynet et al. ..... 405/224.2
4,741,647 * 5/1988 Dumazy et al. ..... 405/195.1 X
5,738,464 * 4/1998 Delrieu ..... 405/195.1 X
5,971,075 * 10/1999 Odru et al. ..... 166/350

* cited by examiner

*Primary Examiner*—David Bagnell
*Assistant Examiner*—Sunil Singh
(74) *Attorney, Agent, or Firm*—Robert J. Edwards; D. Neil LaHaye

(57) ABSTRACT

A riser guide and support mechanism for a floating vessel, and particularly a spar type structure, where the buoyancy can stem extends nearly the entire length of the floating vessel. A riser centralizing element is provided on the riser near the lower end of the buoyancy guide stem. Riser bend limiting elements are positioned on the riser so as to extend above and below the riser centralizing element. Since the buoyancy cans and buoyancy can stem are not required to rotate relative to the stem guides on the floating vessel, the stem guides can be formed from pipe sections that provide a much larger bearing area than is customary.

3 Claims, 3 Drawing Sheets

RISER GUIDE AND SUPPORT MECHANISM

BACKGROUND OF THE INVENTION

1. Field of the Invention

The invention is generally related to offshore drilling operations and more particularly to a riser support and guide mechanism for an offshore floating vessel.

2. General Background

In the drilling and production of hydrocarbons offshore, the development of deep water operations from floating vessels has included the use of tendons and risers under tension extending from the vessel to the sea floor. Such floating vessels have included tension buoyant towers, and spar structures in which the floating structures extend well below the surface of the water and are subjected to heave, pitch, and roll motions.

The lower ends of the tendons and risers are connected to the sea floor by means of additional pipes or risers embedded in and grouted to the sea floor. The upper ends of the tendons and risers pass through openings in the keel or bottom portion of the vessels and are supported vertically by tensioning means located near the water surface.

The openings in the keel serve to constrain the pipe forming the tendons or risers when the vessel is moved laterally with respect to the sea floor connection. Such lateral movement produces bending of the pipe at the constraint opening or rotation of the pipe about the contact of the pipe with the edges of the opening. Bending of the pipe which is normally under tension results in fatigue and wear at the constraint opening.

Riser pipe diameters can vary according to the functional requirements for the riser with typical designs varying from three to twenty-one inches. The opening in the keel guide support frame, for present designs, is sized to pass the connector used to tie the riser to the subsea wellhead. This connector diameter typically varies from twenty-seven to forty-eight inches, depending on the style of tieback connector used. Previous keel sleeves were designed to fill the twenty-nine to fifty inch hole provided in the spar keel riser frame. This resulted in a large diameter and thus very heavy and costly keel sleeve. This large diameter keel sleeve was generally too stiff to efficiently provide the bend limiting function that is desired. In addition, the length of the keel sleeve was required to be quite long (fifty to sixty feet) to ensure that the sleeve did not leave the keel guide as a result of relative motion between the floating structure and the riser.

Prior proposed means for controlling stress at such a point or area of rotation of the pipe have included tapered pipe wall sections of very large wall thickness. The thick tapered wall sections are usually machined from heavy forgings and are very expensive.

U.S. Pat. No. 5,683,205 discloses a stress relieving joint wherein a sleeve member is ensleeved over the pipe portion at the constraint opening and has an inner diameter greater than the outer diameter of the pipe portion. Means at opposite ends of the sleeve centralize the pipe within the sleeve such that the bending stresses at the constraint opening are relieved and distributed to the pipe at the ends of the sleeve member.

U.S. Pat. No. 5,873,677 discloses a stress relieving joint wherein a ball joint and socket assembly is removably attached to the keel at the constraint opening and a sleeve is attached substantially at its midpoint in the ball joint.

The known art does not address all aspects of riser support and guide mechanisms for floating offshore structures.

SUMMARY OF THE INVENTION

The invention addresses the above need. What is provided is a riser guide and support mechanism for a floating vessel, and particularly a spar type structure, where the buoyancy can stem extends nearly the entire length of the floating vessel. A riser centralizing element is provided on the riser near the lower end of the buoyancy guide stem. Riser bend limiting elements are positioned on the riser so as to extend above and below the riser centralizing element. Since the buoyancy cans and buoyancy can stem are not required to rotate relative to the stem guides on the floating vessel, the stem guides can be formed from pipe sections that provide a much larger bearing area than is customary.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
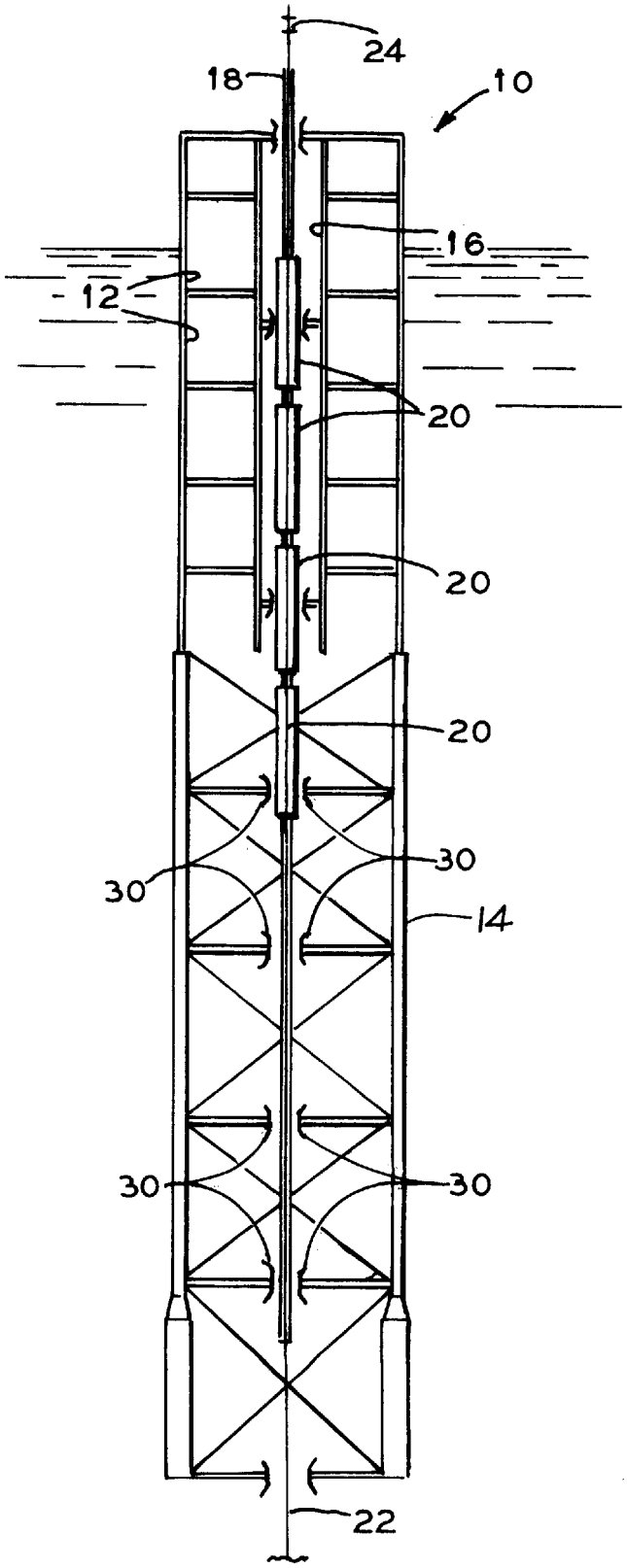
FIG. 1 is a side sectional view of the preferred embodiment of the invention in a floating spar type vessel.

FIG. 1 is a side sectional view that schematically illustrates the invention installed in a truss type spar structure 10 such as that described in U.S. Pat. No. 5,558,467. The upper portion of the spar 10 includes buoyancy tanks 12 that provide sufficient buoyancy to float the structure, with a top deck and associated equipment, in deep water. The lower portion 14 of the spar 10 is essentially an open framework. An opening 16 in the center of the spar receives the buoyancy can stem 18, buoyancy cans 20, and riser 22 within the buoyancy can stem. The riser 22 is only generally referred to as a riser and may be a drilling or production riser, for example. The tops of the buoyancy can stem 18 and riser 22 are attached to the surface control valves 24, which control well functions.

As seen in FIG. 1, the invention is generally comprised of buoyancy can stem 18, riser pipe centralizing element 26, and bend limiting element 28.

Buoyancy can stem 18 extends nearly the entire length of the spar structure. The additional length of the buoyancy can stem 18 distinguishes it from the present state of the art where buoyancy can stems are much shorter and typically extend only a short distance below the buoyancy cans. Otherwise, the buoyancy can stem 18 is similar to that known in the art and is formed from known materials and sized to receive the riser 22 therein so that they are concentric. The upper end of the buoyancy can stem 18 is attached to the surface control valves 24.

Buoyancy cans 20 are attached to the buoyancy can stem 18 and are generally known in the art. Buoyancy cans 20 provide flotation support to the riser 22 to maintain the tension on the riser within acceptable limits.

Figure 2:
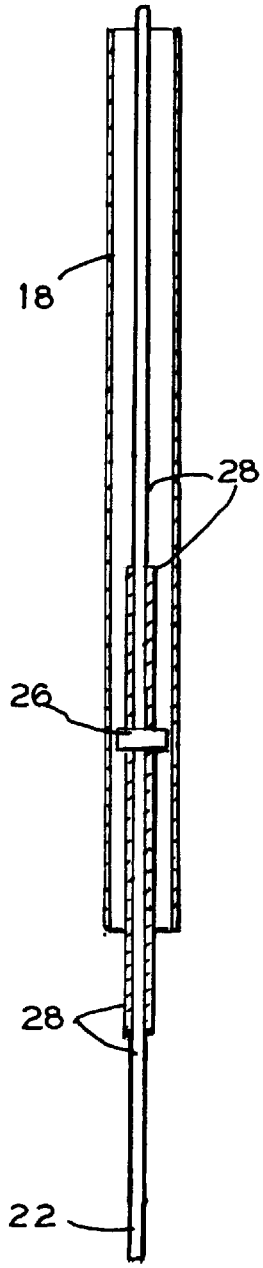
FIG. 2 is an enlarged detail view of the invention.

As seen in the enlarged detail view of FIG. 2, a riser pipe centralizing element 26 is attached to the riser 22 at a position adjacent the lower end of the buoyancy can stem 18. The centralizing element 26 serves to center the riser within the stem 18.

Bend limiting element 28 is attached to the riser 22 and preferably positioned such that bend limiting element 28 extends above and below the centralizing element 26. Bend limiting element 28 serves to stiffen the riser 22 and reduce bending stresses on the riser 22. In the preferred embodiment, bend limiting element 28 tapers from a larger to a smaller diameter as it extends along the riser away from the centralizing element 26. Bend limiting element 28 may be formed from sections of pipe that have thicker walls (larger outer diameter) than the riser pipe at either end of the bending element.

In operation, the buoyancy can stem extensions are installed with the buoyancy cans, with the extensions being lowered down through the stem pipe guides 30. This stem extension approach is especially practical with the truss spar design since horizontal frames of the truss provide a natural support mechanism for the stem guides. The stem extension in the truss region shields the riser 22 from current forces and fatigue caused by vortex induced vibrations. In previous truss spar designs, these current shielding riser conduit pipes were attached to the truss. In the invention, these stem pipe extensions are supported by the riser buoyancy cans. No additional buoyancy support for the total spar structure is needed to support the stem extension pipes, since the support for these pipes is shifted from the hull buoyancy tanks 12 to the riser buoyancy cans 20.

The wear action with the invention occurs between the stem/buoyancy cans and their associated guides. Since stem/can elements are not required to rotate relative to the guides, the guide elements can be formed from slightly larger diameter pipe sections than is normally done. These larger guides provide a very large bearing area relative to existing designs. This larger area means lower contact stresses and less wear.

The invention provides the advantage of a riser support and guide mechanism that is lighter, less expensive, easier to handle during installation, and more wear resistant than present riser support designs. In addition, the bend limiting riser segments can be removed and repaired or replaced.

Figure 3:
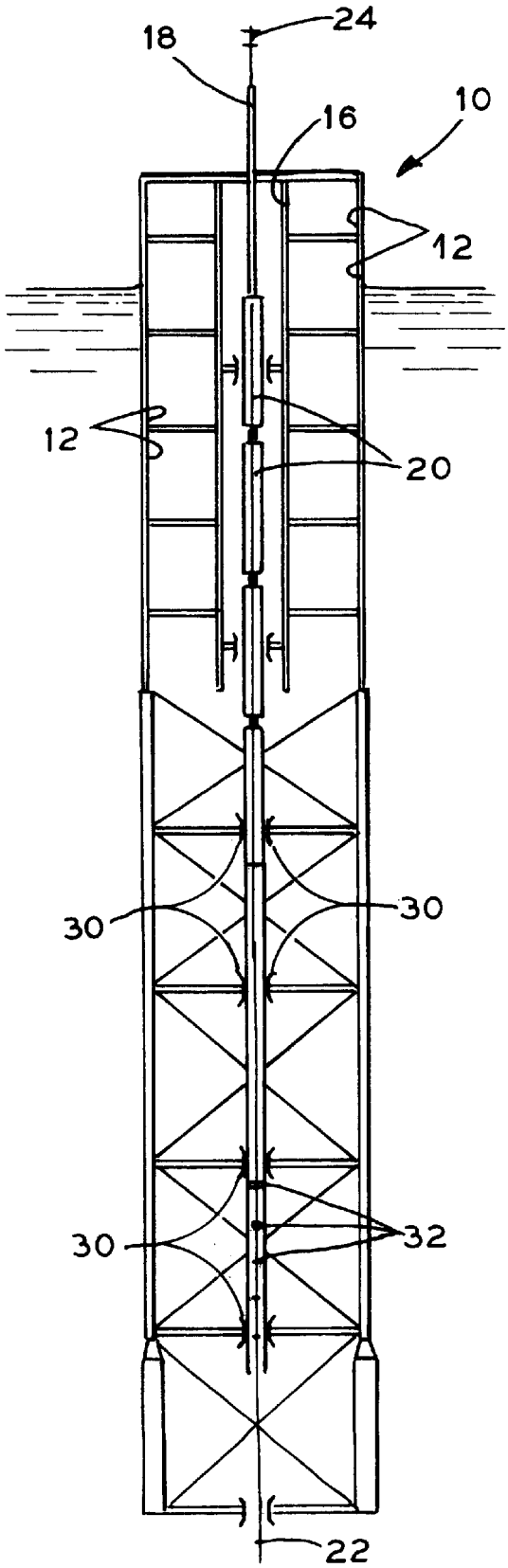
FIG. 3 is a side sectional view of an alternate embodiment of the invention in a floating spar type vessel.
Figure 4:
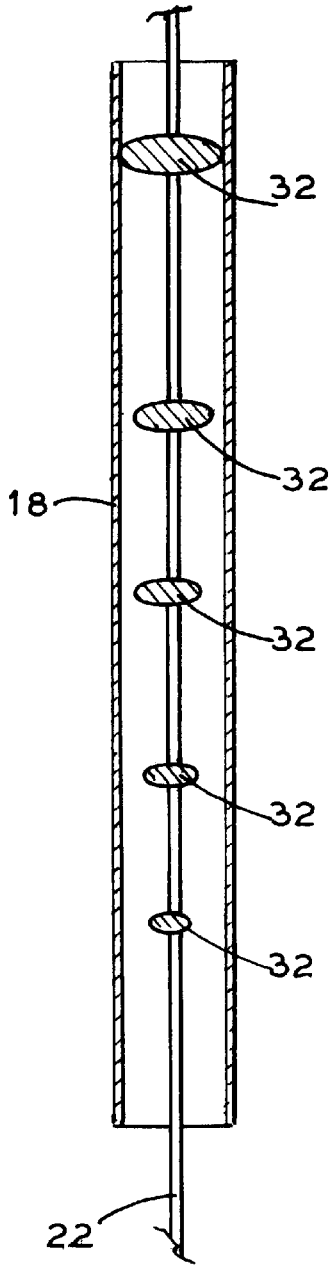
FIG. 4 is an enlarged detail view of the alternate embodiment of FIG. 3.

FIGS. 3 and 4 illustrate an alternate embodiment of the invention. A plurality of ever-decreasing size riser pipe centralizing elements 32 are spaced apart and attached to the riser 22 in the lower region of the buoyancy can stem 18. The centralizing elements 32 progressively decrease in size from the uppermost element to the lowermost element toward the lower end of the buoyancy can stem 18. As the riser 22 is caused to deflect laterally by environmental forces, the centralizing elements contact the inside of the stem 18, thus limiting the movement and bending stress in the riser pipe 22. This allows the bend limiting element 28 illustrated and described in FIGS. 1 and 2 to be eliminated.

Figure 5:
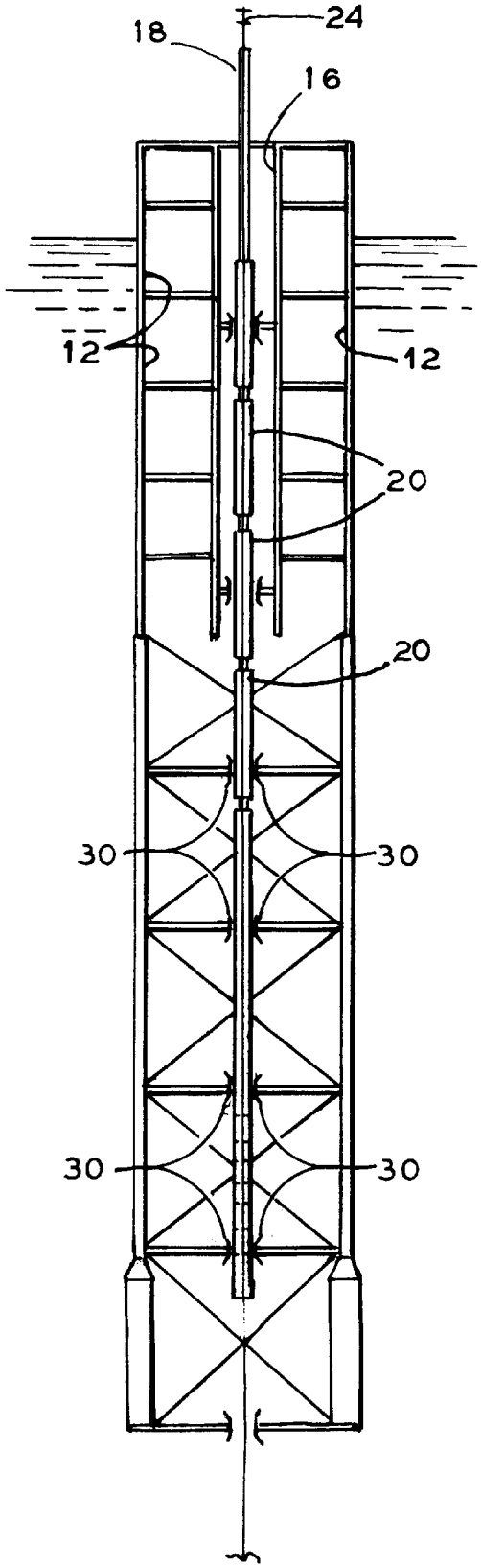
FIG. 5 is a side sectional view of another alternate embodiment of the invention in a floating spar type vessel.
Figure 6:
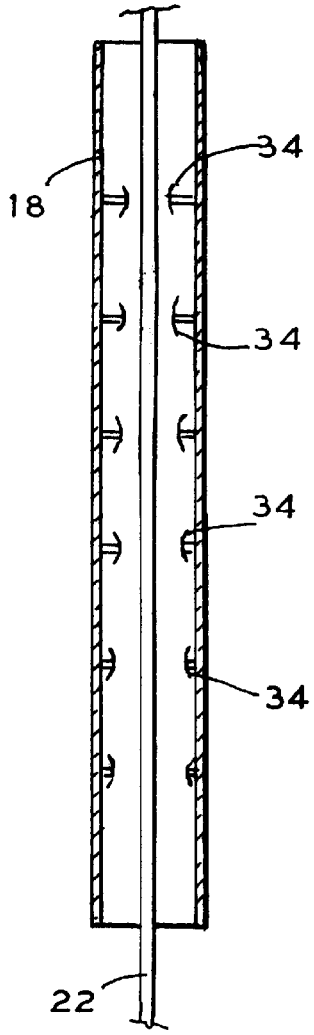
FIG. 6 is an enlarged detail view of the alternate embodiment of FIG. 5.

FIGS. 5 and 6 illustrate another alternate embodiment of the invention. In this embodiment, the bend limiting action is achieved by a series of riser guide rings 34 that are spaced apart and attached to the inner diameter of the buoyancy guide stem 18 at its lower region. The riser guide rings 34 progressively increase in inner diameter from the uppermost ring to the lowermost ring toward the lower end of the buoyancy can stem 18. As the riser 22 is caused to deflect laterally by environmental forces, the guide rings 34 contact the side of the riser, thus limiting the movement and bending stress in the riser pipe 22. In this design, the guide ring with the smallest inner diameter must be large enough to allow the riser tieback connector (not shown) to pass through during normal operations. The required minimum guide ring diameter would be about thirty inches for internal tieback connectors and fifty inches for external tieback connectors. In either case, the smallest guide ring leaves a rather large gap between the riser pipe (typically nine to thirteen inches in diameter) and the guide ring. This large gap will permit a potentially harmful banging action between the riser and the guide ring during movement caused by environmental forces. Using a few centralizing elements above the uppermost guide ring can significantly reduce this banging action.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A support and guide assembly for use with riser pipe in a floating vessel subject to variable motion caused by wind, currents, and wave action, said riser pipe having one end connectable to the sea floor and an upper portion adapted to pass through an opening at the bottom of the vessel, with the riser pipe continuing upward in the vessel through a buoyancy can stem, the support and guide assembly comprising:

a. the buoyancy can stem extends nearly the entire length of the floating vessel;

b. a bend limiting element attached to the riser pipe adjacent the lower end of said buoyancy can stem; and c. a centralizing element attached to said bend limiting element and positioned such that the bend limiting element extends above and below said centralizing element.

2. The support and guide assembly of claim 1, wherein said bend limiting element is formed from at least two concentric pipe segments, with each innermost pipe segment extending a selected distance beyond each end of the immediately surrounding pipe segment.

3. The support and guide assembly of claim 1, wherein said bend limiting element is formed from sections of pipe that have thicker walls than the riser pipe at either end of the bending element.

* * * * *